US005516389A

United States Patent [19]

Kolton et al.

[11] Patent Number: 5,516,389

[45] Date of Patent: May 14, 1996

[54] METHOD FOR USE IN BELT MANUFACTURE AND BELT AND INDICATOR ASSEMBLY

[75] Inventors: Chester Kolton, Westfield; Stuart S. Spater, Livingston, both of N.J.

[73] Assignee: B&G Plastics, Inc., Newark, N.J.

[21] Appl. No.: 283,213

[22] Filed: Jul. 29, 1994

Related U.S. Application Data

[62] Division of Ser. No. 817,750, Jan. 7, 1992, Pat. No. 5,334, 274.

[51] Int. Cl.[6] ..... G09F 23/00

[52] U.S. Cl. ..... 156/92; 40/299; 40/640

[58] Field of Search ..... 40/640, 299, 633, 40/638, 586; 2/311, 312, 336, 338; 283/56, 70; 156/60, 91, 92

[56] References Cited

U.S. PATENT DOCUMENTS

| | | | |
|---|---|---|---|
| 743,984 | 11/1903 | Knothe | 40/640 |
| 1,133,666 | 3/1915 | Pryor | 40/640 |
| 3,513,575 | 5/1970 | Schiller | 40/640 |
| 3,818,897 | 6/1974 | Smith | 40/640 |
| 3,983,604 | 10/1976 | Phillips | 40/640 |
| 4,502,188 | 3/1985 | Kohli | 40/640 |
| 4,576,668 | 3/1986 | Farrelly | 156/93 |
| 4,865,352 | 9/1989 | Gollon | 40/299 |

*Primary Examiner*—Michael W. Ball
*Assistant Examiner*—Daniel J. Stemmer
*Attorney, Agent, or Firm*—Robin, Blecker, Daley & Driscoll

[57] ABSTRACT

A method of making belts through the use of a belt buckle defining a recess at a free end thereof, a detent in the recess and openings extending therethrough into the recess adjacent the detent and a belt blank having an end portion configured to receive the detent and to be received in the belt buckle recess is provided. The method is performed by providing a marketing indicator bearing marketing indicia and of dimensions compatible for assembly with the belt blank end portion and to extend, on assembly of the belt blank and the belt buckle, outwardly of the belt buckle to expose the marketing indicia, the marketing indicator having openings registering with the openings of the belt buckle on such assembly. The marketing indicator is applied to the belt blank by placing the marketing indicator openings so as to be in registry with the belt buckle openings on the assembly. The belt blank is then assembled with the marketing indicator applied thereto with the belt buckle by placing the marketing indicator openings in registry with the belt buckle. Finally, the assembly of the belt blank, the marketing indicator and the belt buckle is secured by placing securing means in the openings of the marketing indicator and the belt buckle.

4 Claims, 5 Drawing Sheets

METHOD FOR USE IN BELT MANUFACTURE AND BELT AND INDICATOR ASSEMBLY

This application is a division of application Ser. No. 07/817,750, filed Jan. 7, 1992, now U.S. Pat. No. 5,334,274.

FIELD OF THE INVENTION

This invention relates generally to improved practices in garments manufacture and pertains more particularly to methods for use in belt making and belt-indication assemblies resulting from such methods.

BACKGROUND OF THE INVENTION

One current conventional method for use in belt making is depicted in FIGS. 1–5. Individual parts used include belt buckle 10 comprised of frame 12 and prong 14, pivotally supported on lower course 12*a* of frame 12, belt blank 16 which defines prong through-aperture 16*a* and and has end course 16*b*, and belt-retaining loop member 18 having opposed ends 18*a* and 18*b*.

Belt blank end course 16*b* is inserted through the open central area 12*b* of buckle 12 and prong 14 is then inserted through prong through-aperture 16*a*. Belt blank end course 16*b* is now folded onto the remnant of the belt about a fold line in registry with the center of opening 16*a*.

With the components so arranged in unsecured manner, save for the assembler's fingers, loop member 18 is applied thereto with its ends 18*a* and 18*b* juxtaposed with one another between the undersurface of belt blank 16 and the folded over end 16*b*.

The assembly, still unsecured, is now inverted to assume the FIG. 5 disposition and stitching 20 is applied to secure the assembly of belt blank, buckle and loop member 18.

For purposes of indicating marketing parameters, e.g. belt manufacturer, price, size and the like the conventional current practice is to use a so-called "swift tag" involving a plastic filament which is passed through an opening in a tag bearing the marketing parameter and through one of the prong receiving openings of the belt blank and then secured at filament ends to remain with the belt until the filament is cut apart at checkout.

The swift tags with plastic filament have tendencies, where belts are hung adjacently, to snag with adjacent belt counterparts undermining the display effort. Also, where the swift tags are applied at the point of belt making, they tend undesirably, to become entangled with one another in the course of packaging, shipping and unpacking.

SUMMARY OF THE INVENTION

A primary object of the represent invention is to overcome the foregoing disadvantages attending the described conventional current belt making and merchandizing practice.

A more particular object of the invention is the provision of improved methods for use in belt making and improved assemblies of belts and marketing indicators therefor.

In attaining the foregoing and other objects, the subject invention provides a method for use in belt making wherein a marketing indicator is secured with the belt at the time of the foregoing assembly stitching operation.

Per the invention, in making belts having the described buckle, following the step of applying the belt-retaining loop member to the belt blank, a portion of a marketing indicator is applied to the undersurface of the belt blank, with the belt blank in its FIG. 5 disposition, interiorly of the boundary of the subsequent stitching, thereby to be secured with the stitched assembly.

When the stitching is performed, as is customary, in the FIG. 5, i.e. inverted disposition of the belt blank, the invention preferably looks to retentive application of the marketing indicator to the undersurface of the belt blank. To this end, the portion of the indicator which is disposed interiorly of the stitching, or at least a part of such portion, has an adhesive backing applied thereto. Accordingly, upon inversion of the belt blank, the indicator remains with the belt blank, without assembler assistance.

While the member attached with the heretofore known belt assembly has above been referred to as itself a marketing indicator, it is more often the case that marketing information is not assigned or known at the point of belt making, but is to be assigned at a subsequent juncture. To accommodate such situation, the present invention contemplates that the attached member be a blank which is receptive to a subsequently applied marketing indicator, desirably having an adhesive backing for retentive application to the blank and sized to be within the borders of the exposed area of the blank, i.e. that area not within the stitching.

In a still further aspect, the invention affords improved removability of belt marketing indicators. Thus, it will be appreciated that the belt stitching which secures the assembly imparts perforations to the marketing indicator facilitating its removal by tearing across the line of perforations.

The above-noted entanglement problems are overcome by the practice and assembly of the invention since the marketing indicator lies flat against the undersurface of the belt.

The foregoing and other objects and features of the invention will be further understood from the following detailed description of a preferred embodiment thereof and from the drawings, wherein like reference numerals identify like components throughout.

DETAILED DESCRIPTION OF PREFERRED EMBODIMENTS AND PRACTICES

Figure 1:
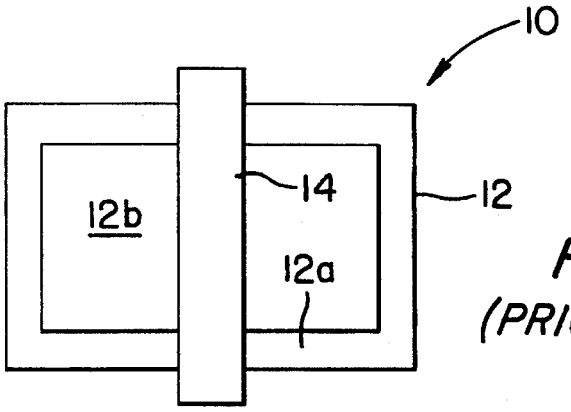
FIG. 1 (PRIOR ART)
FIGS. 1–5, above discussed, described a first prior art practice in belt making.
Figure 2:
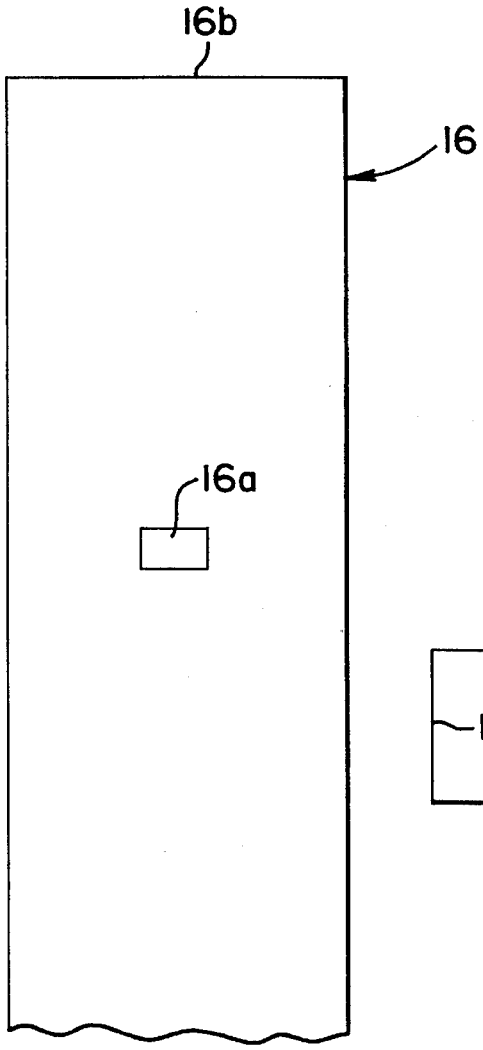
FIG. 2 (PRIOR ART)
Figure 3:
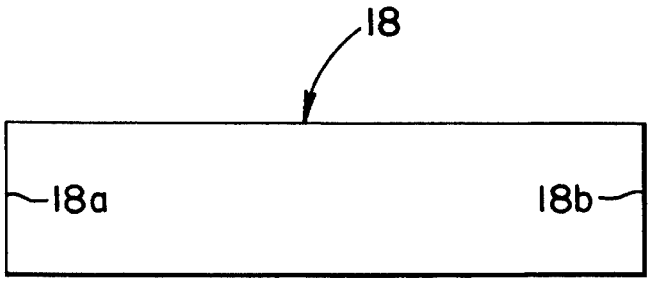
FIG. 3 (PRIOR ART)
Figure 6:
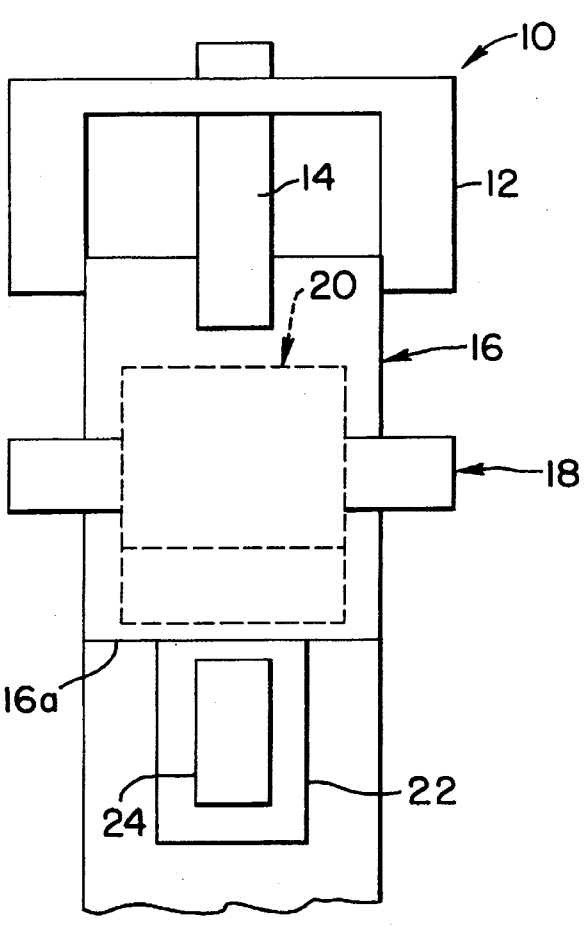
FIG. 6 is an underside plan view of a first belt making practice and assembly in accordance with the invention.
Figure 5:
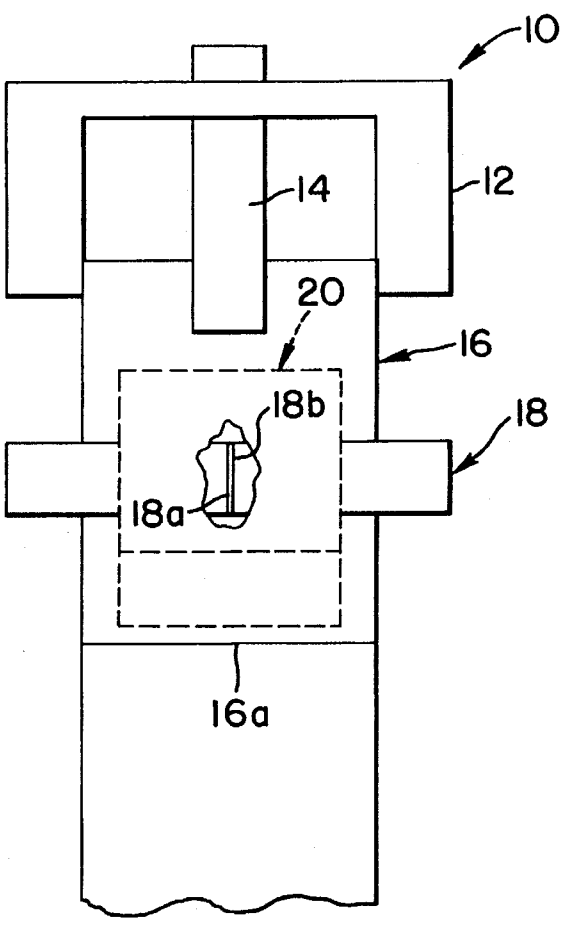
FIG. 5 (PRIOR ART)
Figure 4:
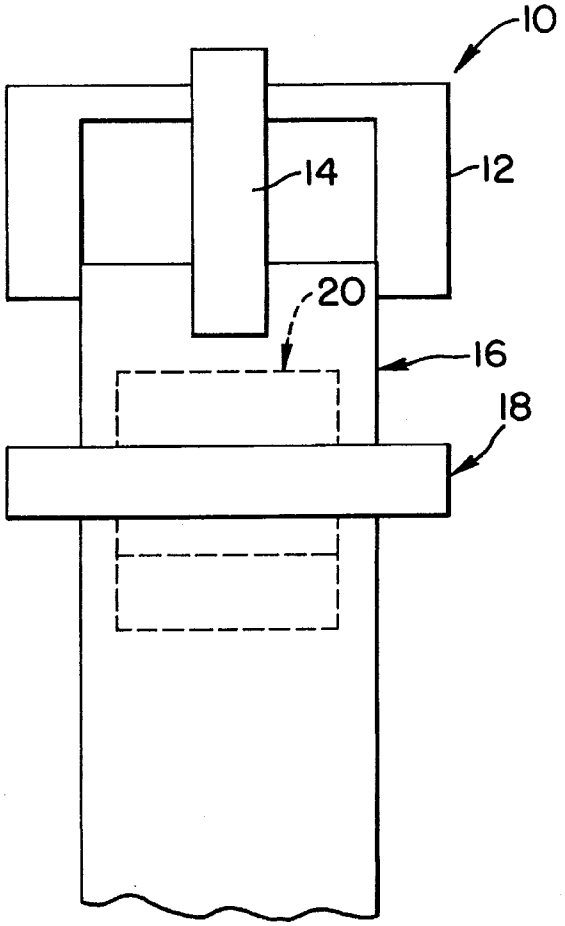
FIG. 4 (PRIOR ART)
Figure 7:
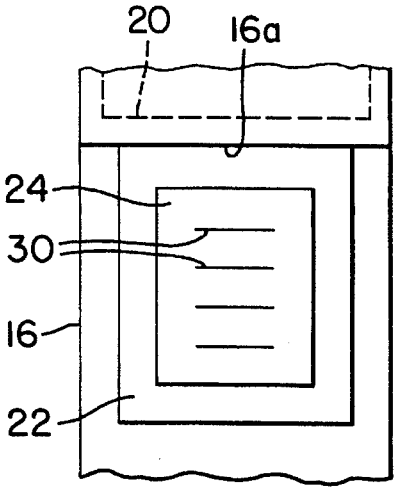
FIG. 7 repeats a portion of FIG. 6 with marketing indication lines shown on the marketing indicator.
Figure 8:
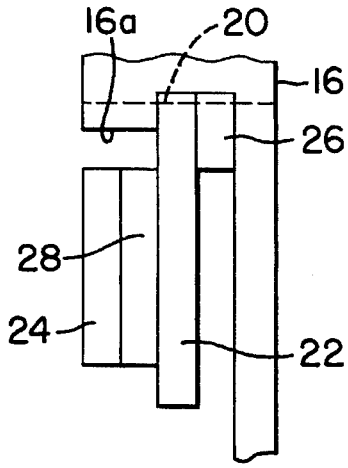
FIG. 8 is a right side elevation of FIG. 7.

Referring to FIGS. 6–8, components 10, 14, 16 and 18 and stitching 20 have been discussed above. The further components include indicator strip 22 and marketing indicator element 24, having respective adhesive layers 26 and 28 thereon. As indicated schematically in FIG. 7, element 24 may include lines 30 of marketing indicia.

Prior to practice of the prior art step of applying belt-retaining loop member 18 to belt blank 16, a portion of indicator strip 22 is applied to the undersurface of belt blank 16 at a location known to be interior of the boundary of the subsequent stitching 20. This step, through adhesive layer 26 maintains the indicator strip securely with the belt blank, freeing the assembler of this task and may be practiced with the belt not yet in receipt of its buckle and not yet folded, as desired.

When sewing is subsequently performed to form stitching 20, it will be seen from FIG. 8, that a course of the stitching, i.e., the lowermost stitching course, encompasses a portion of indicator strip, perforating the same. As above alluded to, it will be appreciated that the belt stitching which secures the assembly imparts perforations to the marketing indicator facilitating its removal by tearing across the line of perforations, which can be done at the facility checkout station.

While the member attached with the heretofore known belt assembly has above been described as comprising an indicator strip, receptive of a marketing indicator element, the latter to be applied to the belt at the point of belt making, it is sometimes the case that marketing information is known at the point of belt making, rather than being assigned at a subsequent juncture. Per the described embodiment of FIGS. 6–8, the invention addresses the more common situation, i.e., by providing indicator strip 22 and marketing indicator element 24, having respective adhesive layers 26 and 28 thereon. Indicator element 24 may evidently be applied to indicator strip 22 at any time, e.g., at the marketing facility remote from the point of belt making and following packing, shipping and unpacking.

To accommodate the less common situation, the invention contemplates that the attached member be a strip inclusive of marketing data, whereby strip 22 bears the indicia and element 24 is not employed.

Figure 9:
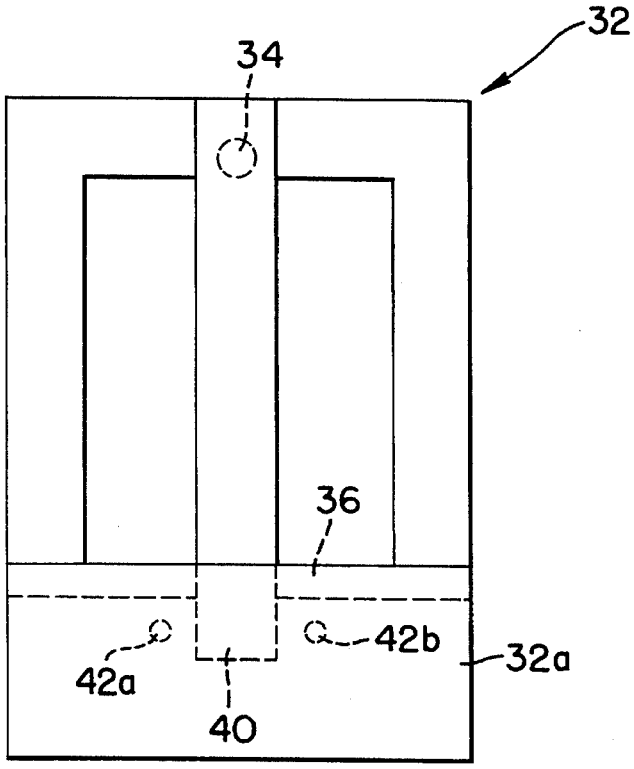
FIG. 9 (PRIOR ART)
FIG. 9 is a top plan view of a type of prior art belt buckle different from that of FIGS. 1–5.
Figure 10:
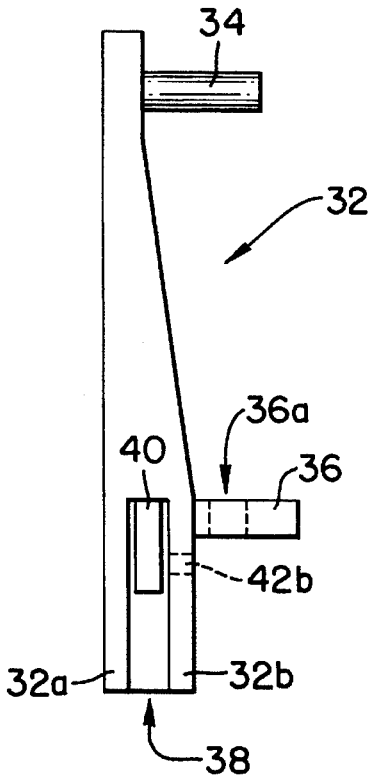
FIG. 10 (PRIOR ART)
FIG. 10 is a side elevation of FIG. 9.
Figure 11:
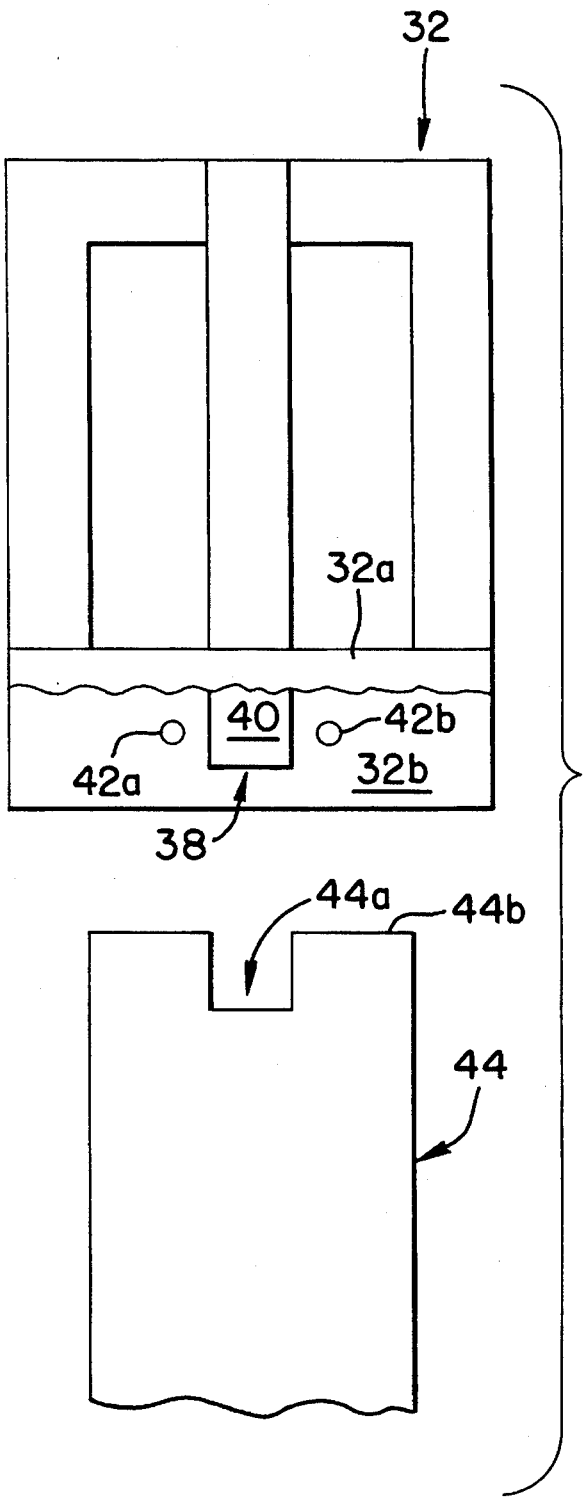
FIG. 11 (PRIOR ART)
FIG. 11 is a top plan view of the buckle of FIGS. 9 and 10 with a portion thereof cutaway to reveal interior detail thereof and also showing the prior art belt blank used with the buckle.

Turning now to FIGS. 9–11, a further prior art belt and buckle embodiment is shown. The buckle, identified as 32, is an integral body having depending stud 34 and belt tail-receiving member 36 having belt tail passage 36*a*. At its end distal from stud 34, buckle 32 has upper and lower extents 32*a* and 32*b*, which define therebetween a recess 38 in which is disposed a detent member 40. Buckle extent 32*b* has threaded openings 42*a* and 42*b* extending into recess 38 aside detent member 40.

As is seen in FIG. 11, belt blank 44 has a receptor slot 44*a* opening into its end 44*b* which is configured compatibly with detent member 40 for receipt thereof. In the prior art practice, belt blank 44 is inserted into recess 38 and is secured therein by threaded bolts which are screwed into threaded openings 42*a* and 42*b*.

Figure 13:
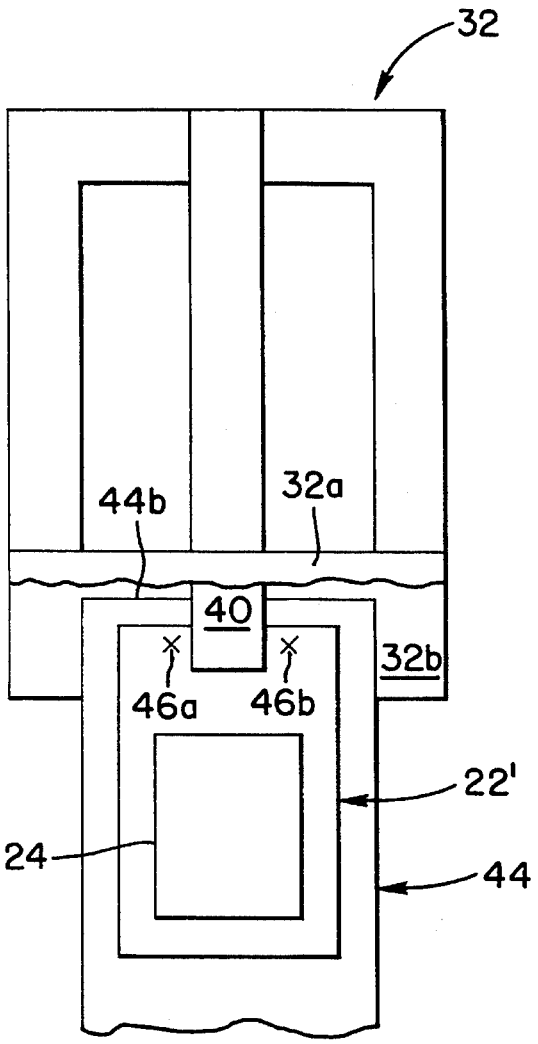
FIG. 13 is a repeat showing of the buckle of FIG. 11 with the belt blank of FIG. 11 and the marketing indicator of FIG. 12 applied to the buckle.
Figure 12:
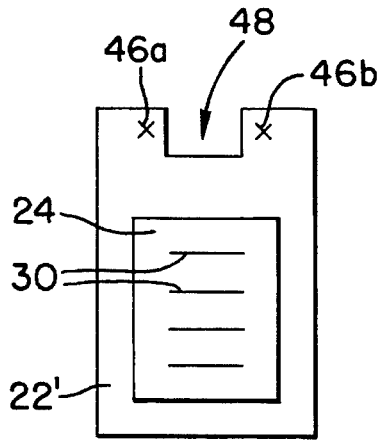
FIG. 12 is a top plan view of a further marketing indicator in accordance with the invention.
Figure 14:
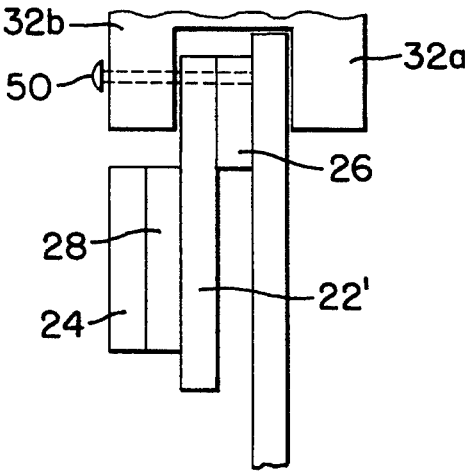
FIG. 14 is a partial side elevation of FIG. 13, depicting the securement of the unsecured assembly of FIG. 13.

In accordance with the invention at hand, marketing indicator 22' is provided in the configuration shown in FIG. 12, i.e., to have in addition to the components previously described die cuts 46*a* and 46*b* and a detent receiving opening 48. As is seen in assembled views of FIG. 13 and FIG. 14, the end portion of indicator 22' is nested in the buckle recess 38 atop belt blank 44 with die cuts 46*a* and 46*b* in registry with openings 42*a* and 42*b*. Screws 50 are threaded into openings 42*a* and 42*b* to extend through die cuts 46*a* and 46*b*, and belt buckle openings and through the belt blank 44 to secure the assembly of components depicted in FIGS. 9–14.

The invention contemplates that indicator strips, with adhesive backing 26 may be secured thereby to an assembler feeder in the form of a conveyor, to extend outwardly of a margin of the conveyor and be readily removable by an assembler in the course of manufacture of the belt, the adhesive backing 26 being a pressure-sensitive adhesive and the indicator strips being comprised of a polyolefin fiber which is tear-resistant. The tear resistance of the indicator strip is diminished at the afore-mentioned perforation line caused by stitching 20 extending therethrough. Where indicator elements 24 are employed, the adhesive backing 28 thereof is likewise selected to be a pressure-sensitive adhesive.

By way of summary of the invention and introduction to the ensuing claims, it will be seen to comprise method and article of manufacture aspects. In method terms, the invention looks to first and second practices, respectively for belts of the two foregoing types. In connection with the open frame buckle first discussed, the method looks to the making of belts through the use of a belt buckle having a prong pivotally supported on an open frame of the buckle, a belt blank having a prong-passage opening therethrough at a location distal from a first end of the belt blank, and a belt-retaining loop member, the method comprising the steps of inserting the first end of the belt blank through the buckle open frame and passing the belt prong through the belt blank prong-passage opening, folding the belt blank onto itself about a fold line extending through the belt blank prong-passage opening and inserting the buckle prong through the prong-passage opening, applying a marketing indicator to the belt blank at a location within the fold of the belt blank, applying the belt-retaining loop member to the folded belt blank in circumscribing relation thereto and securing the assembly of the folded belt blank, the buckle, the marketing indicator and the belt-retaining loop member, while maintaining the marketing indicator at such location within the fold of the belt blank.

The step of applying the marketing indicator to the belt blank is preferably practiced by adhesively securing the marketing indicator to the belt blank prior to practice of the securing step, wherein the maintenance of the marketing indicator at such location within the fold of the belt blank is effected in the applying step.

The securing step is preferably effected by applying stitching to the assembly of the folded belt blank, the buckle, the marketing indicator and the belt-retaining loop member.

The securing step is practiced to secure the marketing indicator to the belt blank with the stitching creating a line of perforations in the marketing indicator.

The marketing indicator applying step is preferably practiced by selecting the marketing indicator to be a blank which is receptive to a subsequently applied marketing indicia element.

The marketing indicia element is preferably selected in size to be less than the dimensions of the marketing indicator blank extending outwardly of the location thereof within the belt blank fold.

Practice of the invention in its first belt approach yields, in combination, a belt blank having a prong-passage opening therethrough at a location distal from a first end of the belt blank, the belt blank being folded onto itself to have the belt blank first end upon the belt blank, a belt buckle having a prong pivotally supported on an open frame of the buckle, the belt buckle being within the fold of the belt blank, with the prong extending through the prong-passage opening of the belt blank, a belt-retaining loop member secured to the folded belt blank and in circumscribing relation thereto, a marketing indicator having at least a portion thereof disposed with respect to the belt blank at a location within the fold of the belt blank, and means for securing to one another the folded belt blank, the belt-retaining loop-member and the marketing indicator portion.

Practice of the invention in its second approach looks to a method for the making of belts through the use of a belt buckle having a belt blank-receiving opening at an end thereof and a belt blank having an end portion dimensioned to be received in the belt buckle blank-receiving opening and means for securing the belt blank end portion in the belt buckle blank-receiving opening, the method comprising the steps of providing a marketing indicator of dimensions compatible with the belt blank end portion to be applicable thereto but to extend, on assembly of the belt blank and the buckle, outwardly of the belt buckle, assembling the marketing indicator with the belt blank, and applying the securing means to the belt blank with the marketing indicator assembled therewith and to the buckle.

Various of the subsidiary steps of the first method are usable in the second method as discussed above.

Practice of the invention in its second belt approach yields, in combination, a buckle having a belt blank-receiving opening at an end thereof, a belt blank having an end portion resident in the belt buckle blank-receiving opening, a marketing indicator resident in part in the belt buckle blank-receiving opening and contiguous with the belt blank, and means for securing the belt blank end portion and the marketing indicator part resident in the belt blank-receiving opening to the belt buckle.

While the invention has been described with two particular forms of belt buckles, virtually countless other forms of belt buckles are known which fall into the two generic categories so defined, i.e., wherein the belt buckle is ensnared within a folded belt blank, and wherein the belt buckle is joined with a belt blank without folding of the belt blank. The invention of course contemplates assemblies and practices adapted to such other forms of belt buckles.

By way of example of a further species within the first generic category, belts are known wherein a belt blank has first and second ends and wherein the belt blank is folded at each end thereof-about respective interlocking, prongless buckle parts which interlock in the form of a Figure-8. By way of example of a further species within the second generic category, belt buckles are in widespread use wherein the belt buckle has a clamp pivotally supported thereon to biasingly engage a belt blank for mutual securement thereof, e.g., belts having blanks which exhibit diverse colors, such as black and brown, on opposite surfaces thereof, i.e., reversible belt blanks.

In this connection, various changes in structure to the described articles of manufacture and modifications in the described practices may evidently be introduced without departing from the invention. Accordingly, it is to be understood that the particularly disclosed and depicted embodiments are intended in an illustrative and not in a limiting sense. The true spirit and scope of the invention is set forth in the following claims.

What is claimed is:

1. A method for the making of belts through the use of a belt buckle defining a recess at a free end thereof, a detent in said recess and openings extending therethrough into said recess adjacent said detent and a belt blank having an end portion configured to receive said detent and to be received in said belt buckle recess, said method providing belts with marketing indicia and comprising the steps of;

(a) providing a marketing indicator bearing said marketing indicia and of dimensions compatible for assembly with said belt blank end portion and to extend, on assembly of said belt blank and said belt buckle, outwardly of said belt buckle to expose said marketing indicia, the marketing indicator having openings registering with the openings of the belt buckle on such assembly;

(b) applying said marketing indicator to said belt blank in manner placing said marketing indicator openings so as to be in registry with said belt buckle openings on said assembly;

(c) assembling said belt blank with said marketing indicator applied thereto with said belt buckle in manner placing said marketing indicator openings in registry with said belt buckle openings; and (d) securing the assembly of said belt blank, said marketing indicator and said belt buckle by placing securing means in said openings of said marketing indicator and said belt buckle.

2. The method claimed in claim 1 wherein said step (b) is practiced in part by adhesively securing said marketing indicator to said belt blank.

3. The method claimed in claim 1 wherein said step (b) is practiced by selecting said marketing indicator to be a blank which is receptive to a subsequently applied marketing indicia element.

4. The method claimed in claim 3 including said further step of applying to said marketing indicator blank such marketing indicia element.

* * * * *